US009163362B2

(12) United States Patent
Bachmann et al.

(10) Patent No.: US 9,163,362 B2
(45) Date of Patent: Oct. 20, 2015

(54) PERMANENT WAY FOR A RAILWAY AND DEVICE FOR READING INFORMATIONS CARRIERS PROVIDED IN THE PERMANENT WAY

(75) Inventors: Hans Bachmann, Neumarkt (DE); Richard Ziegler, Neumarkt (DE)

(73) Assignee: RAIL.ONE, Neumarkt (DE)

( * ) Notice: Subject to any disclaimer, the term of this patent is extended or adjusted under 35 U.S.C. 154(b) by 0 days.

(21) Appl. No.: 12/742,348

(22) PCT Filed: Nov. 4, 2008

(86) PCT No.: PCT/DE2008/001795

§ 371 (c)(1), (2), (4) Date: May 11, 2010

(87) PCT Pub. No.: WO2009/062464

PCT Pub. Date: May 22, 2009

(65) Prior Publication Data

US 2010/0264222 A1 Oct. 21, 2010

(30) Foreign Application Priority Data

Nov. 12, 2007 (DE) ..... 10 2007 054 221

(51) Int. Cl.
*E01B 35/00* (2006.01)

(52) U.S. Cl.
CPC ..... *E01B 35/00* (2013.01)

(58) Field of Classification Search
USPC ..... 235/487, 492; 340/10, 572
See application file for complete search history.

(56) References Cited

U.S. PATENT DOCUMENTS

| | | | | |
|---|---|---|---|---|
| 7,551,058 | B1 * | 6/2009 | Johnson et al. | 340/10.41 |
| 2005/0242957 | A1 * | 11/2005 | Lindsay et al. | 340/572.7 |
| 2007/0016479 | A1 * | 1/2007 | Lauper | 705/14 |
| 2008/0068164 | A1 * | 3/2008 | Campbell | 340/572.1 |

FOREIGN PATENT DOCUMENTS

| | | | |
|---|---|---|---|
| DE | 195 10 560 | A | 9/1996 |
| DE | 100 21 927 | | 10/2001 |
| EP | 1 521 072 | | 4/2005 |
| EP | 1 612 118 | | 1/2006 |
| EP | WO 2007/012851 | | 2/2007 |
| EP | WO 2007/036307 | A | 4/2007 |
| EP | 1 783 026 | A | 5/2007 |

* cited by examiner

*Primary Examiner* — Matthew Mikels
(74) *Attorney, Agent, or Firm* — Lucas & Mercanti, LLP

(57) ABSTRACT

Superstructure for a railway, wherein at least one component of the superstructure (8) has a data carrier (7) for digitally stored data readable with a reading device (11).

17 Claims, 3 Drawing Sheets

Figure 1:
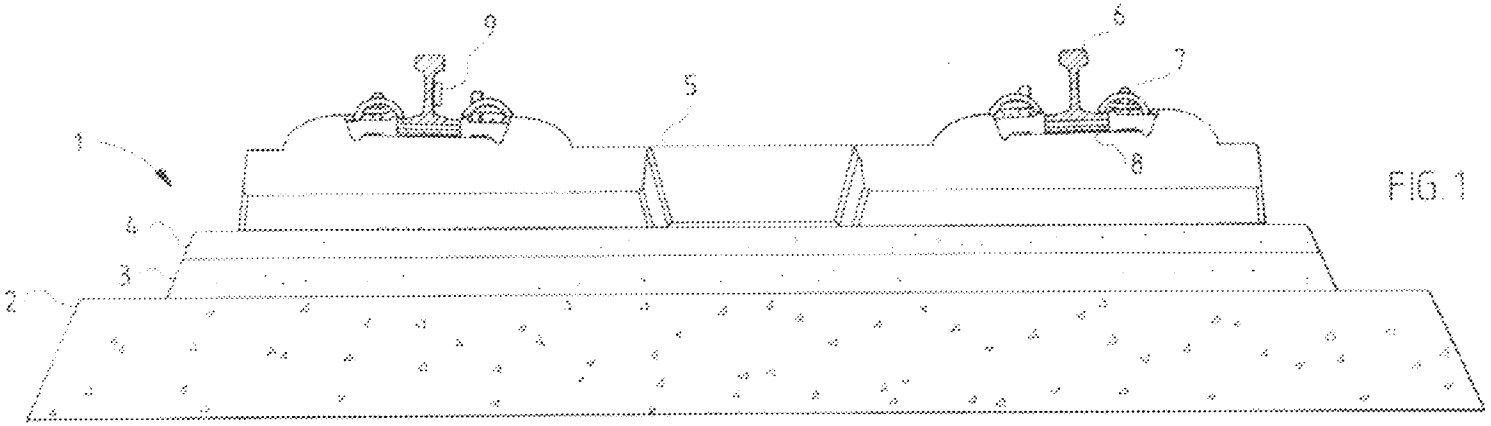

PERMANENT WAY FOR A RAILWAY AND DEVICE FOR READING INFORMATIONS CARRIERS PROVIDED IN THE PERMANENT WAY

This application is a 371 of PCT/DE2008/001795 filed Nov. 4, 2008, which in turn claims the priority of DE 10 2007 054 221.8 filed Nov. 12, 2007, the priority of both applications is hereby claimed and both applications are incorporated by reference herein.

The invention relates to a superstructure for a railway.

The superstructure of conventional railways comprises components such as rails, sleepers, fixing components, resilient layers, inserts, a ballast bed, one or more layers of a fixed carriageway, a bonded or non-bonded support layer, a reinforcement or a bias reinforcement. As rail vehicles are set to have a long service life of the order of plural decades, in the case of any damage that may arise it is frequently difficult to identify the corresponding component and to obtain information relating to the component. Only a few components of the superstructure are normally provided with data at all, e.g. on concrete sleepers usually there is a manufacturer's mark, a model reference and the year of manufacture. As these data are present in the form of alphanumeric marks applied to the surface, their acquisition is complex. On other components of the superstructure, on the other hand, no characterising data are given at all, so that no component-specific data can be obtained at all subsequently.

The object of the invention is therefore to indicate a superstructure for a railway in which the reading of data is simplified.

To achieve this, in a superstructure of the type mentioned in the introduction it is provided that at least one component of the superstructure has a data carrier readable by a reading device for digitally stored data.

The invention is based on the knowledge that the superstructure or one of its components can be provided with a data carrier, in which component-specific data are stored. By the digital storage, data can be stored in a practical manner in any quantity and permanently in the data carrier.

The superstructure according to the invention may comprise one or more components from the following group: rail, sleeper, fixing component, resilient layer, insert, ballast bed, fixed carriageway, layer of the fixed carriageway, bonded or non-bonded support layer, reinforcement and/or a bias reinforcement. Thus a whole range of options are available for mounting the data carrier.

The data carrier may be mounted on various points on the component of the superstructure according to the invention. According to a first embodiment, the data carrier can be mounted on the surface of the component of the superstructure. This has the advantage of good accessibility and minimising interference in the reading of the data carrier. In addition, data carriers can also be mounted retrospectively on the surface of the component of the superstructure.

Alternatively, the data carrier can be incorporated at least in part in the component of the superstructure according to the invention. In this type of mounting, the data carrier is well-protected from mechanical influences. As a further alternative, it is possible to mount the data carrier in a cavity in the component, so that the data carrier is protected both from mechanical influences and from weathering.

According to an extension of the invention, it can be provided that the data carrier may be read without its own power supply. This has the advantage that the service life of the data carrier is not dependent on the service life of a power supply. Alternatively, it is possible that the data carrier has its own power supply, which for example comprises a battery or rechargeable battery. In this embodiment, the distance between the reading device and the data carrier may be greater.

In an advantageous embodiment of the invention, the data carrier of the superstructure according to the invention may have a writable or rewritable storage device. This makes it possible subsequently to store data which are not yet known at the point of manufacture. In this manner, certain data can be gathered and read over a relatively long period.

Advantageously, the superstructure according to the invention may comprise a data carrier which is disposed approximately in the middle of the sleeper. The data carrier may also be located at a point on the sleeper with a reduced thickness of concrete, as then there is no risk of interference during reading.

In order to detect data regarding one or more components of the superstructure, it may be provided that the data carrier has at least one measuring device for detecting measured values. Preferably, measured values detected by means of the measuring device may be stored in the storage device of the data carrier. This makes it possible for the data to be not only available at the time of the reading by the reading device but permanently. It may be provided that the measuring device is formed to measure a force or a pressure. This makes it possible to detect the stress of the component when a rail vehicle passes over. Likewise, the force or pressure curve during such passage can be detected in order by means of this data to monitor the state of the component of the superstructure and to recognise changes or damage.

Alternatively or in addition, the measuring device can also be formed to measure a temperature. As a further alternative, the measuring device can be formed to measure expansion of a component of the superstructure in order by means of these measured values to obtain data regarding deformation, signs of fatigue or damage.

It is also conceivable that the measuring device is formed to detect the geographical position of the component of the superstructure, in particular by means of a GPS receiver.

According to an extension of the invention, the data carrier can be formed to transmit data to another data carrier. This not only permits automatic reading of the data but also automatic forwarding of data by the data carrier to other data carriers until the data reaches a receiver. In this connection, the data carrier of the superstructure according to the invention can be so formed that it transmits data upon the occurrence of an event. An example of the occurrence of an event is the exceeding or falling short of a threshold value by one of the values detected by the measuring device. This permits for example the automatic transmission of the measured values and the data derived therefrom concerning the damage or deterioration of a component of the superstructure, without the need to carry out a reading operation externally.

Advantageously, the data carrier can be formed to transmit the data at one of the following frequencies: 125 kHz, 13.56 MHz, 433 MHz, 866 MHz, 915 MHz, and 950 MHz. However, frequencies of 2.45 GHz or 5.8 GHz are also conceivable.

In addition, the invention relates to a device for reading data carriers. The device has a mobile carriage movable on a superstructure of the type described.

Figure 2:
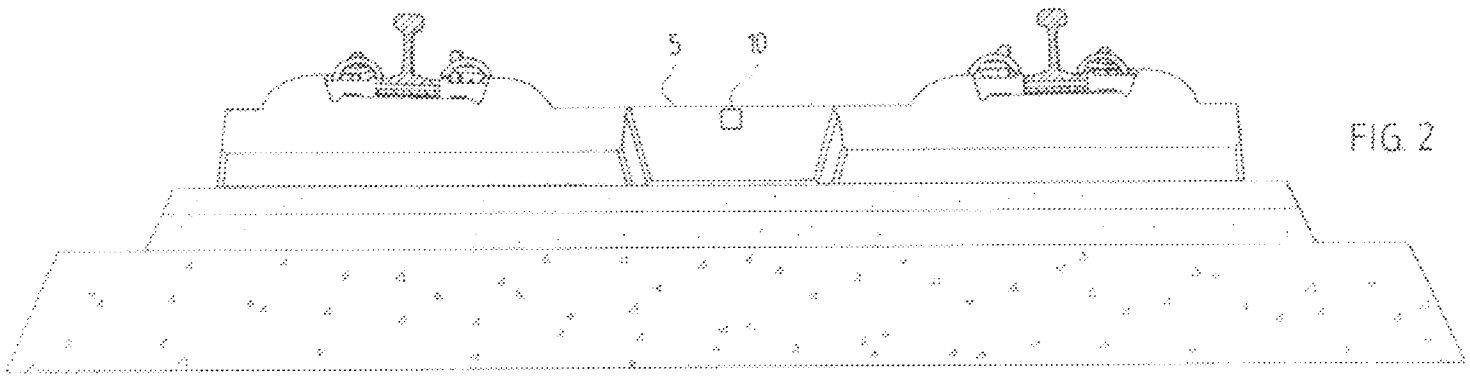
Figure 3:
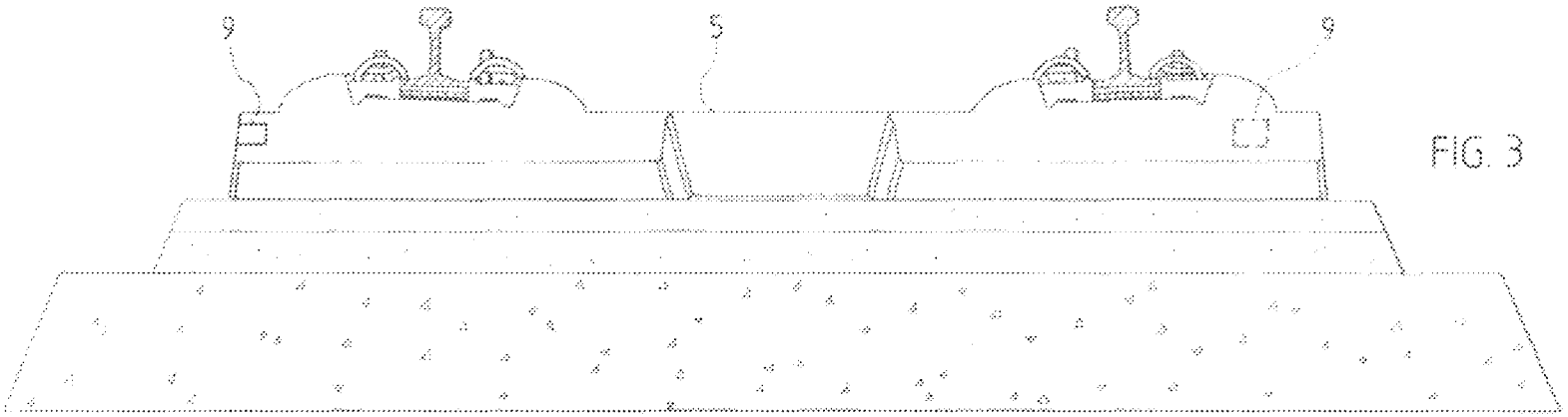
Figure 4:
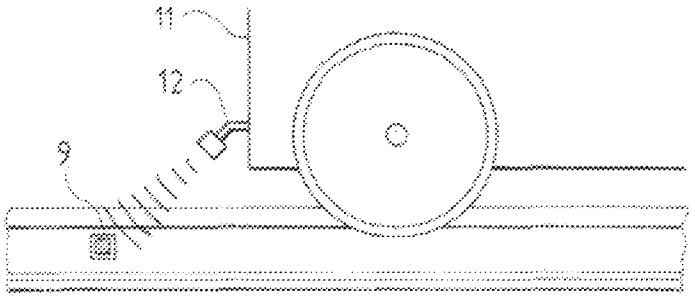

Further advantages and details of the invention are described below with reference to the figures, which are schematic representations and show:

FIG. 1 a first embodiment of the invention in a section view;

FIG. 2 a further embodiment of a superstructure according to the invention;

FIG. 3 a further embodiment of a superstructure according to the invention;

FIG. 4 a reading device according to the invention; and

Figure 5:
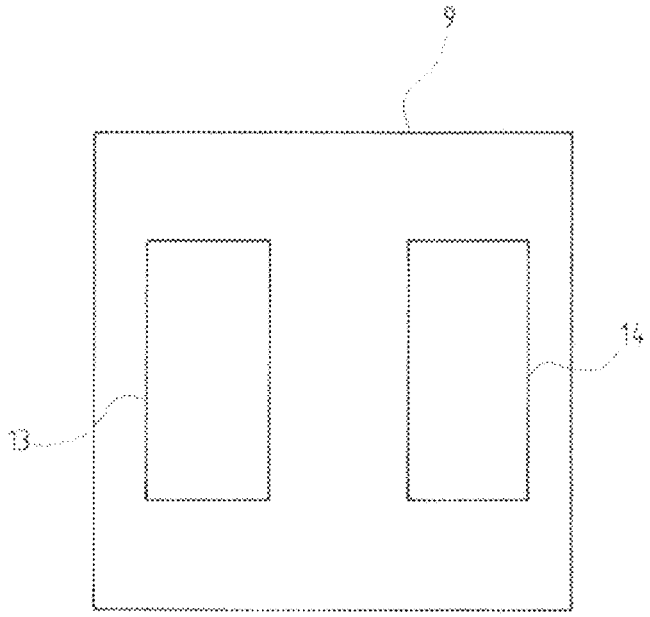

FIG. 5 a data carrier according to the invention.

FIG. 1 shows a fixed carriageway 1 for rail vehicles in a section view. On a lower support layer 2, are located asphalt layers 3, 4, on which a superstructure is mounted. In the embodiment shown, the superstructure is formed by a concrete sleeper 5, rails 6, rail fixings 7 and a resilient layer 8 disposed below the rail 6.

On the left-hand rail 6 in FIG. 1, on the vertical section, a data carrier 9 is mounted. The data carrier 9 can either be already mounted during manufacture of the fixed carriageway, or be mounted subsequently on a component of the superstructure. The data carrier 9 is formed in the embodiment shown as a RFID transponder and is a passive tag. Passive tags do not have their own power supply, but can be read by an externally generated electromagnetic field. In the data carrier 9 is a writable storage device, in which before or during manufacture of the fixed carriageway data can be stored. For example, each data carrier can be allocated a specific number by means of which at a later date data about the manufacture of the respective component or its installation can be retrieved. The reading of the data stored in the data carrier can be effected by means of a carriage movable on the rails 6 and comprising a corresponding reading device.

FIG. 2 shows a second embodiment of the invention in a section view. Unlike the first embodiment, a data carrier 10 is mounted on the exterior of the concrete sleeper 5. The data carrier 10 comprises a measuring device which is formed to measure expansion. The measured values detected are permanently stored in the storage device of the data carrier 10 and can be read subsequently by means of a reading device. By means of the measured values stored, changes in the concrete sleeper 5 can be detected, e.g. if the measured expansions exceed a specified threshold value. Such an unexpected high level of expansion can point to a damaged concrete sleeper or other unfavourable change requiring maintenance or repair. With the aid of the data stored in the storage device, the respective component of the superstructure can be easily identified.

FIG. 3 shows a third embodiment in which the concrete sleeper 5 is provided with two data carriers 9. The data carrier 9 shown on the left-hand side of FIG. 3 is so incorporated into the concrete sleeper 5 that it is visible on the exterior. The other data carrier 9 shown on the right-hand side of FIG. 3 is located inside the concrete sleeper 5. This data carrier 9 is particularly well protected against outside influences, however it cannot be subsequently exchanged, which is possible in the case of the data carrier 9 shown on the left-hand side of FIG. 3.

FIG. 4 shows a carriage 11 movable on a railway and having a reading device 12 for reading data carriers 9.

FIG. 5 shows schematically a data carrier 9 which has a storage device 13 and a measuring device 14.

The invention claimed is:

1. Superstructure for a railway, comprising:

a sleeper having a cavity on an exterior surface of the sleeper; and a data carrier having digitally stored data therein and readable with a reading device for reading digitally stored data, wherein the data carrier is embedded in the cavity of the sleeper, is visible on the exterior surface of the sleeper, and is externally accessible from the exterior surface of the sleeper; and the digitally stored data includes a specific number allocated to the data carrier whereby data about manufacture or installation of the sleeper can be retrieved.

2. Superstructure according to claim 1, wherein the data carrier is readable.

3. Superstructure according to claim 1, wherein the data carrier may be read without its own power supply.

4. Superstructure according to claim 1, wherein the data carrier has a power supply.

5. Superstructure according to claim 1, wherein the data carrier has a writable or rewritable storage device.

6. Superstructure according to claim 1, wherein the data carrier is disposed in approximately the middle of the sleeper.

7. Superstructure according to claim 1, wherein the data carrier is disposed in the sleeper at a point with reduced thickness of concrete.

8. Superstructure according to claim 1, wherein the data carrier has at least one measuring device for detecting measured values.

9. Superstructure according to claim 8, wherein the measured values detected by means of the measuring device are storable in a storage device.

10. Superstructure according to claim 8, wherein the measuring device is formed for measuring a force and/or a pressure.

11. Superstructure according to claim 8, wherein the measuring device is formed for measuring a temperature.

12. Superstructure according to claim 8, wherein the measuring device is formed for measuring an expansion.

13. Superstructure according to claim 8, wherein the measuring device is formed for detecting a geographical position, by means of a GPS receiver.

14. Superstructure according to claim 1, wherein the data carrier is formed for transmitting data to one or more other data carriers.

15. Superstructure according claim 14, wherein a data carrier is formed for transmitting data upon the occurrence of an event.

16. Superstructure according to claim 15, wherein the data are transmitted if at least one measured value detected by the measuring device exceeds or falls short of a threshold value.

17. Superstructure according to claim 1, wherein the data carrier is formed for transmitting data at one of the following frequencies: 125 kHz, 13.56 MHz, 433 MHz, 866 MHz, 915 MHz, 950 MHz, 2.45 GHz or 5.8 GHz.

* * * * *

UNITED STATES PATENT AND TRADEMARK OFFICE

CERTIFICATE OF CORRECTION

PATENT NO. : 9,163,362 B2
APPLICATION NO. : 12/742348
DATED : October 20, 2015
INVENTOR(S) : Hans Bachmann et al.

It is certified that error appears in the above-identified patent and that said Letters Patent is hereby corrected as shown below:

Title Page,

(73) Assignee should read: RAIL.ONE GMBH, Neumarkt (DE)

Signed and Sealed this
Fifth Day of April, 2016

Michelle K. Lee

Michelle K. Lee
*Director of the United States Patent and Trademark Office*